United States Patent [19]

Cochran et al.

[11] 3,988,071

[45] Oct. 26, 1976

[54] CLEANING BAR ASSEMBLY FOR COMPACTOR WHEELS

[75] Inventors: Thomas Eugene Cochran, Yorkville; Rodger Lloyd Moring, Bristol, both of Ill.

[73] Assignee: Caterpillar Tractor Co., Peoria, Ill.

[22] Filed: Aug. 13, 1975

[21] Appl. No.: 604,278

[52] U.S. Cl. ..... 404/129

[51] Int. Cl.[2] ..... E01C 19/26

[58] Field of Search ..... 404/121, 129; 172/547, 172/610; 301/41, 43

[56] References Cited

UNITED STATES PATENTS

| | | | |
|---|---|---|---|
| 3,633,471 | 1/1972 | Randour | 404/121 |
| 3,851,988 | 12/1974 | Kitai et al. | 404/129 |
| 3,909,147 | 9/1975 | Takata | 404/133 |

*Primary Examiner*—Henry S. Jaudon
*Attorney, Agent, or Firm*—Phillips, Moore, Weissenberger Lempio & Strabala

[57] ABSTRACT

A compactor wheel is rotatably mounted on a vehicle and comprises a plurality of pads disposed on the periphery thereof for compacting purposes. A cleaning bar assembly is mounted on the axle housing of the vehicle and comprises an integral U-shaped frame having a plurality of cleaning bars secured thereon to extend inwardly between the pads of the compactor wheel for removing material therefrom. The bars are secured on a pair of legs of the frame which straddle the compactor wheel in parallel relationship relative to the rotational axis thereof. Each of the legs has an adapter means secured on an outboard end thereof adapted to selectively attach an outboard support bar thereon to form a box-like frame enclosing the compactor wheel.

8 Claims, 4 Drawing Figures

CLEANING BAR ASSEMBLY FOR COMPACTOR WHEELS

BACKGROUND OF THE INVENTION

This invention relates to a cleaning bar assembly for compactor wheels of the type disclosed in U.S. Pat. No. 3,633,471, assigned to the assignee of this application.

Such compactor wheels tend to pick-up and retain material between the pads thereof, particularly when operated over damp materials such as clay. The build-up of such materials between the pads will reduce the operating efficiency of the compactor wheel unless means are provided for continuously cleaning the same. To this end, a frame having a plurality of cleaning bars secured thereon is normally positioned adjacent to the compactor wheel to continuously break-up the material upon rotation of the compactor wheel. The frame may comprise a closed box-like structure completely surrounding the compactor wheel, such as the type disclosed in above-referenced U.S. Pat. No. 3,633,471.

SUMMARY OF THE INVENTION

An object of this invention is to provide an improved and multi-purpose cleaning bar assembly for a compactor wheel. The cleaning bar assembly constitutes an integrally formed U-shaped member having an inboard support bar disposed transversely relative to a rotational axis of the compactor wheel and secured to an axle housing of the vehicle. A pair of legs are integrally secured to opposite ends of the support bar in cantilevered relationship thereon to straddle either side of the compactor wheel. A plurality of cleaning bars are secured to each of the legs and extend inwardly therefrom and between respective ones of the pads secured on the periphery of the compactor wheel. An adapter means is secured on the end of each of the legs for selectively attaching an outboard support bar thereon pursuant to applications wherein it is desirable to provide a box-like cleaning bar assembly for the compactor wheel.

BRIEF DESCRIPTION OF THE DRAWINGS

Other objects of this invention will become apparent from the following description and accompanying drawings wherein.

DETAILED DESCRIPTION

Figure 2:
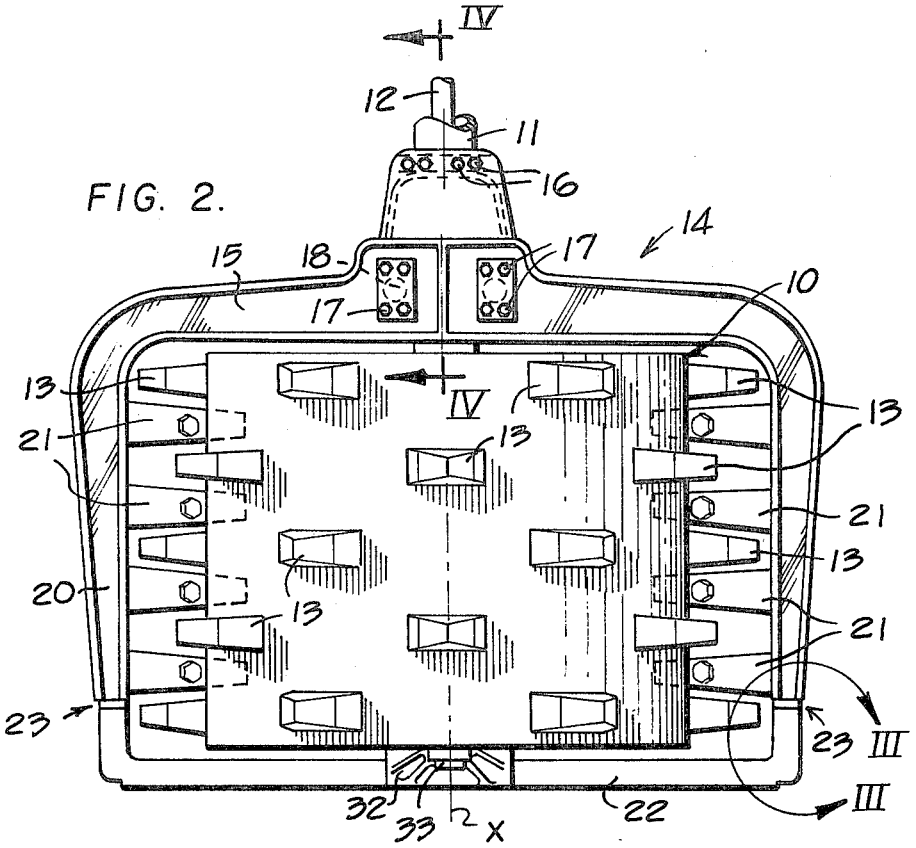
FIG. 2 is a top plan view of the compactor wheel and cleaning bar assembly.
Figure 1:
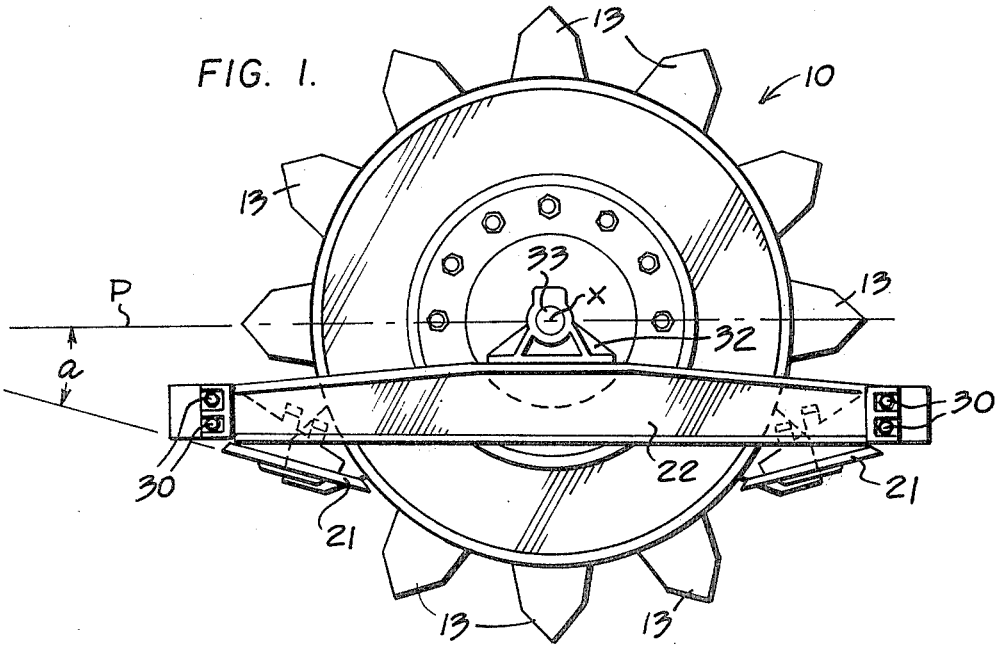
FIG. 1 is a side elevational view of a compactor wheel having a cleaning bar assembly mounted adjacent thereto.

Referring to FIGS. 1 and 2, a compactor wheel 10 is rotatably mounted on an axle housing 11, suitably secured to a frame of a vehicle (not shown), for rotation about a central longitudinal axis X thereof. The compactor wheel is adapted to be driven by an axle 12 rotatably mounted in the housing and operatively connected to the compactor wheel by a suitable gear train (not shown) fully disclosed in U.S. Pat. No. 3,633,471. A plurality of circumferentially disposed pads 13 are secured on the periphery of the compactor wheel to extend radially outwardly therefrom for soil compacting purposes.

Figure 4:
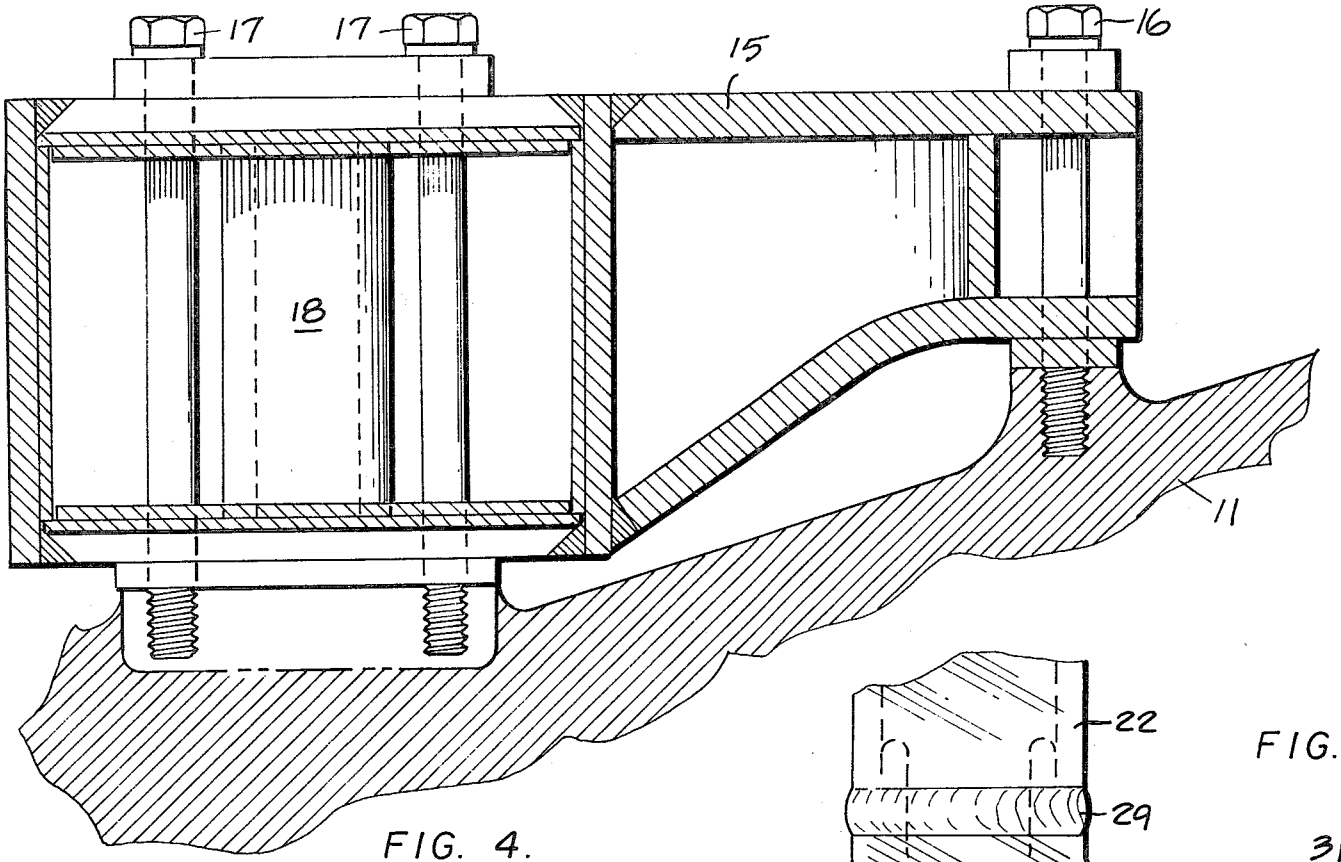
FIG. 4 is a sectional view taken in the direction of arrows IV—IV in FIG. 2.

This invention relates to a cleaning bar assembly 14 secured to axle housing 11 for continuously engaging and cleaning materials which may tend to lodge between pads 13. The cleaning bar assembly comprises an integrally formed one-piece U-shaped frame 14 having an inboard support bar 15 disposed transversely relative to axis X. Referring to FIG. 4, the support bar is secured intermediate its ends to axle housing 11 by a plurality of bolts 16 and 17, the latter bolts securing a U-shaped strap 18 (not fully shown) beneath the axle housing.

A pair of legs 19 and 20 are integrally secured in cantilevered relationship on opposite ends of support bar 15 to straddle the compactor wheel on either side thereof. The legs, disposed in parallel relationship relative to axis X, have a plurality of cleaning bars 21 secured thereon. The cleaning bars extend inwardly from the legs, towards axis X and between respective ones of pads 13 for cleaning purposes.

Referring to FIG. 1, each cleaning bar is preferably disposed at an acute angle *a* relative to a horizontally disposed imaginary horizontal plane P, preferably selected from the range of from 5° to 25°. In addition to be downwardly inclined, the cleaning bars are disposed below axis X to further aid in dispelling materials downwardly and away from the compactor wheel. It should be noted that the disposition of the cleaning bars on either side of the compactor wheel will function to clean the same regardless of the direction of rotation thereof.

Figure 3:
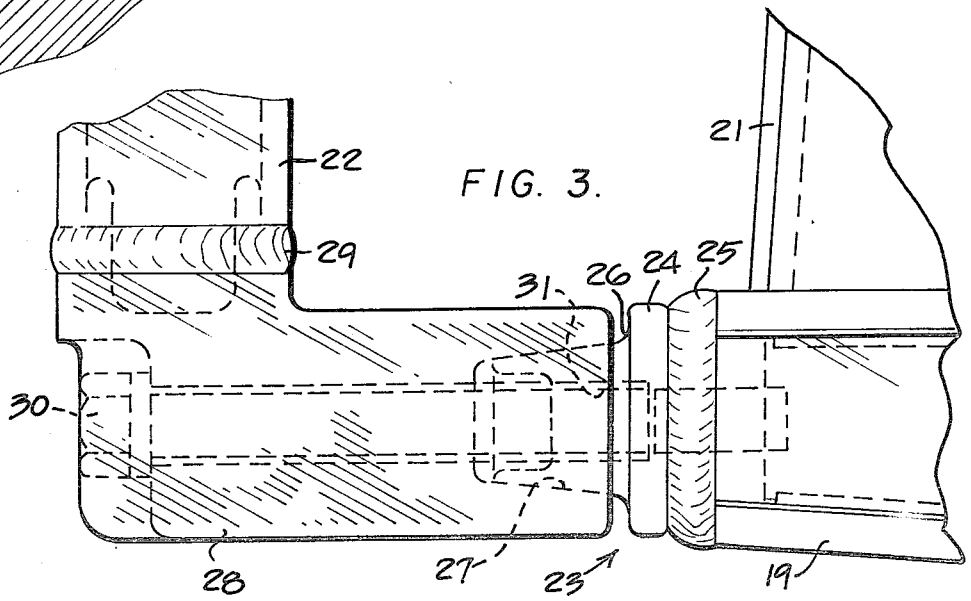
FIG. 3 is an enlarged view of the area of the cleaning bar assembly subscribed by circle III—III in FIG. 2.

In certain compacting operations and for certain vehicles it may prove desirable to utilize a box-like cleaning bar assembly in lieu of the U-shaped one described above. In such applications, an outboard support bar 22 can be attached to the outer ends of legs 19 and 20 expeditiously. Referring to FIG. 3, an adapter means 23 is secured on the end of each of the legs in parallel relationship relative to axis X to facilitate such expeditious attachment of the outboard support bar thereon and to provide a coupling therebetween which exhibits a high degree of structural integrity.

Each adapter means comprises a vertically spaced pair of annular support members 24 each having its inner end secured to leg 19, for example, by an annular weld 25. The outer end of member 24 has a frusto-conically shaped support portion 26 formed integrally thereon and adapted to self-center within a like-shaped recess 27 formed in an opposed end of an L-shaped member 28. The latter member is integrally secured to a respective end of support bar 22 by an annular weld 29.

Thus, upon tightening of a bolt 30, threadably mounted in threads 31 formed internally in member 24, member 28 will be drawn tightly onto conically shaped support portion 26 of the adapter means. Referring to FIGS. 1 and 2, a bracket 32, secured on outboard support bar 22 intermediate its ends, is suitably mounted on a trunnion 33. The trunnion may be suitably secured to the final drive cover of compactor wheel 10 to provide further support for the outboard support bar as well as for cleaning bar assembly 14.

I claim:

1. In a vehicle comprising an axle housing, a compactor wheel rotatably mounted on said axle housing for rotation about a central longitudinal axis thereof and having a plurality of circumferentially disposed pads secured on the periphery thereof to extend radially outwardly therefrom and a cleaning bar assembly secured to said axle housing, the invention wherein said cleaning bar assembly constitutes an integrally formed U-shaped frame having an inboard support bar disposed transversely relative to said axis and secured to said axle housing, a pair of legs cantilevered on said support bar to straddle said compactor wheel on either side thereof and disposed in parallel relationship relative to said axis, a plurality of cleaning bars secured to each of said legs to extend inwardly therefrom towards said axis and between respective ones of said pads, and an adapter means secured on an end of each of said legs adapted for selectively attaching an outboard support bar thereon.

2. The vehicle of claim 1 wherein each of said adapter means comprises an annular support member having its inner end secured to a respective leg and disposed in parallel relationship relative to said axis.

3. The vehicle of claim 2 wherein said support member is secured to said leg by an annular weld.

4. The vehicle of claim 2 wherein an outer end of said support member is frusto-conically shaped.

5. The vehicle of claim 2 further comprising means forming threads internally of the outer end of each said support member.

6. The vehicle of claim 5 further comprising an outboard support bar attached to each of said adapter means by a bolt threadably attached to respective threads thereof.

7. The vehicle of claim 6 wherein each end of said support bar has a member secured thereto and wherein each of said bolts extends through a respective one of said members.

8. The vehicle of claim 7 further comprising a trunnion secured to said compactor wheel and a bracket secured to said outboard support bar intermediate the ends thereof, said bracket mounted on said trunnion.

* * * * *